US005079667A

United States Patent [19]

Kasano et al.

[11] Patent Number: 5,079,667

[45] Date of Patent: Jan. 7, 1992

[54] RELAY DRIVING CIRCUIT FOR A LATCH-IN RELAY

[75] Inventors: Fumihiro Kasano, Osaka, Japan; Hans Sauer, Deisenhofen, Fed. Rep. of Germany; Heinz Ritter, Schongau, Fed. Rep. of Germany; Wolf Steinbichler, Feilnbach, Fed. Rep. of Germany; Sepp Antonitsch, Otterfing, Fed. Rep. of Germany

[73] Assignee: Matsushita Electric Works, Ltd., Japan

[21] Appl. No.: 443,511

[22] Filed: Nov. 30, 1989

[30] Foreign Application Priority Data

Jan. 26, 1989 [JP] Japan ..... 1-17344
Jun. 24, 1989 [JP] Japan ..... 1-161254

[51] Int. Cl.[5] ..... H01H 47/00
[52] U.S. Cl. ..... 361/156; 361/160
[58] Field of Search ..... 361/139, 143, 144, 152, 361/154, 155, 156, 160, 170

[56] References Cited

U.S. PATENT DOCUMENTS 4,234,903 11/1980 Harper ..... 361/154
4,271,450 6/1981 Nishimura et al. ..... 361/155
4,533,972 8/1985 Ohashi ..... 361/156
4,621,299 11/1986 Hill ..... 361/151

*Primary Examiner*—A. D. Pellinen
*Assistant Examiner*—Jeffrey A. Gaffin
*Attorney, Agent, or Firm*—Stevens, Davis, Miller & Mosher

[57] ABSTRACT

A relay driving circuit for a latch-in type magnetic relay having an excitation coil, generating a set current and a reset current of opposite polarity for the coil. A capacitor is provided between the input terminals of the circuit in series with the coil. A set switch is connected in series with the coil and the capacitor, and a reset switch is connected across the series combination. An input voltage level detector is provided to make the set switch conductive, thereby applying the input voltage to the excitation coil and the capacitor to provide the set current. As the input voltage decreases below the trigger level, the detector makes the reset switch conductive to allow the capacitor to discharge current in the opposite direction through the excitation coil. The circuit includes a disable switch responsive to the capacitor being charged to a voltage level sufficient to provide the reset current, the disable switch setting the set switch to a non-conductive state to thereby prevent the capacitor voltage from being reversely applied.

7 Claims, 7 Drawing Sheets

RELAY DRIVING CIRCUIT FOR A LATCH-IN RELAY

BACKGROUND OF THE INVENTION

1. Field of the Invention

The present invention is directed to a relay driving circuit, and more particularly to such a driving circuit for driving a magnetic relay of latch-in type to selectively set and reset the relay contact by charging and discharging a current to and from a capacitor connected in series with an excitation coil of the relay.

2. Description of the Prior Art

For driving a magnetic relay it is known in the art to provide a circuit in which a capacitor is connected in series with an excitation coil of the relay so that the relay can be set and reset into the contact closing and opening positions upon energization of the excitation coil selectively by charge and discharge currents of opposite polarity directed to and from the capacitor. FIG. 8 illustrates a general diagram of the known relay driving circuit which comprises a capacitor C connected in series with an excitation coil L of a magnetic relay, an input voltage level detector 10A connected to detect a level of voltage applied to the circuit, a set switch 20A connected in series with the series combination of the excitation coil L and the capacitor C, a reset switch 30A connected in parallel with the series combination of the coil L and the capacitor C. The input voltage level detector 10A compares the input voltage level with a predetermined trigger voltage level and produces a first control output when the input voltage level exceeds the trigger level and otherwise produces a second control output. In response to the first control signal the set switch 20A is rendered to be conductive while the reset switch 30A is kept non-conductive to thereby apply the input voltage to the series combination of the excitation coil L and the capacitor C for flowing a charge current through the excitation coil L in one direction, actuating the relay into a set position of closing the relay contact. At this time the capacitor C is charged for ready to discharge sufficient current through the excitation coil L in the opposite direction. In response to the second control signal from the input voltage level detector 10A, or when the input voltage is decreased below the trigger level, the reset switch 30A is made conductive to thereby establish a closed loop of the excitation coil L, the capacitor C, and the reset switch 30A, allowing the discharge current from the capacitor C to flow through the excitation coil L in the opposite direction, thus actuating the relay into a reset position of closing the relay contact. In this manner, the relay is set and reset by changing the level of the input voltage to the driving circuit.

The above described relay driving circuit is realized in the prior art, for example, by the circuit of FIG. 9. In the circuit, the input voltage level detector 10A comprises an operational amplifier OP which compares an input voltage divided by a divider network of resistors $R_1$ and $R_2$ with a reference level vref from a reference voltage source $E_1$ to provide a high level output when the former is greater than the latter as representative of that the input voltage level exceeds a trigger voltage level. Otherwise, the operational amplifier $OP_1$ produce a low level output as the second control signal. The set switch 20A comprises a pair of coupled transistors Q4 and Q5, the latter of which is inserted in series with the series combination of the excitation coil L. The reset switch 30A comprises a set of transistors Q6, Q8, and FET Q7, the last of which is connected across the series combination of the excitation coil L and the capacitor C. The transistor Q6 and FET Q7 are connected to derive its source of voltage from the capacitor C.

In operation, when the input voltage Vi is increased to such an extent that the divided voltage $V_1$ becomes greater than the reference level Vref, the input voltage level detector 10A provides H-level output to turn on the transistors Q4 and Q5, whereby the input voltage Vi is applied to the series circuit of the excitation coil L, the capacitor C, and the transistor Q5 to charge the capacitor C with a current flowing through the excitation coil L in one direction. Thus, the relay is energized to one polarity and actuated into the set position. At this time, the transistor Q6 is kept turned on by the H-level output from the input voltage level detector 10A to thereby turn off the FET Q7 and the transistor Q8, rendering the reset switch 30A non-conductive. When the input voltage Vi is removed or decreased to an extent that the divided voltage $V_1$ falls below the reference voltage Vref, the detector 10A provides a low-level output to thereby turn off the transistors Q4 and Q5, making the set switch 20A non-conductive and therefore disallowing the current to flow in the same direction through the excitation coil L. At this time, the transistor Q6 is turned off in response to the L-level output from the detector 10A to thereby turn on the FET Q7 and the transistor Q8 to establish the closed loop of the excitation coil L, the capacitor C and the transistor Q8. Whereby the capacitor C is allowed to discharge a current of the opposite direction through the excitation coil L for actuating the relay into the reset position of closing the relay contact.

However, the above circuit of FIG. 9 is found to have a serious problem in that there may be an unacceptable delay in actuating the relay into the reset position from the set position. Such delay comes from the fact that even after the input voltage is decreased below the trigger level in order to reset the relay, the input voltage detector 10A Will receive the voltage developed across the capacitor C to continuously provide the H-level output, thereby keeping the transistor Q5 turned on while keeping the transistor Q8 still turned off and therefore disallowing the capacitor C to discharge the reset current through the excitation coil L. This is true as the transistor Q5 will act to reversely flow a current (as indicated by an arrow in the figure) from the capacitor C through the excitation coil L when the input voltage is decreased to zero or below the critical level. Consequently, the input voltage level detector 10A responds in an unintended manner to still provide the H-level output until the capacitor C is discharged to a certain extent, thus causing the delay in turning on the transistor Q8 and resetting the relay.

To eliminate the above delay or the unintended reverse current flow from the capacitor to the detector 10A, there has been proposed an improved relay driving circuit. In the improved circuit, which is illustrated in FIG. 10, the transistors Q4 and Q5 forming the set switch 20B are connected in Darlington pair. With the Darlington connection, the transistor Q4 may flow a reverse current but the transistor Q5 will not allow the reverse current therethrough, inhibiting the unintended reverse current from the capacitor C to the detector 10B and therefore preventing the unintended operation of providing the H-level output from the detector 10B at the very moment of the input voltage decreasing to zero or below the trigger level.

Although the fault operation of the circuit, another preventing the faulty operation of the circuit, another problem has been encountered in using the Darlington circuit. That is, since the Darlington circuit requires a higher input voltage than a single transistor circuit for producing the set and reset currents of a prescribed level sufficient to magnetize the excitation coil, the circuit of FIG. 10 correspondingly requires more input power and is found to be unsatisfactory from the viewpoint of reducing the energy consumption. This is especially true when the relay driving circuit is adapted to a battery powered portable device in which energy saving is a primary concern.

SUMMARY OF THE INVENTION

The above problems have been successfully eliminated in the present invention which prevents the above described unintended reverse current flow without employing the Darlington circuit. A relay driving circuit of the present invention is intended for use with a latch-in type magnetic relay having an excitation coil which causes the relay to assume a set position of closing a relay contact when energized by a set current of a given polarity and to assume a reset position of opening the relay contact when energized by a reset current of opposite polarity.

The relay driving circuit is connected to a capacitor inserted in series with the excitation coil of the relay and comprises a pair of input terminals and an input voltage level detector connected across the input terminals. The level detector provides a first control signal when an input voltage applied to the circuit is detected to exceed a predetermined trigger voltage level and provides a second control signal when the input voltage is detected to be less than the trigger level. A set switch is connected in a series relation with the series combination of the excitation coil and the capacitor between said input terminals. The set switch is rendered conductive in response to the first control signal to apply the input voltage to the series combination of the excitation coil and the capacitor, thereby providing the set current through the excitation coil and charging the capacitor. Connected in parallel with the series combination of the excitation coil and the capacitor is a reset switch which is, in response to the second control signal, made conductive to allow the capacitor to discharge a current as the reset current in the opposite direction through the excitation coil for energizing the excitation to opposite polarity.

The circuit is characterized to include a disable switch which monitors a voltage developed across the capacitor and makes the set switch non-conductive when the capacitor is charged up to a voltage level sufficient to be ready for providing the reset current to the excitation coil, whereby preventing the voltage of the capacitor from falsely actuating the input voltage level detector.

Accordingly, once after the capacitor is charged up to a sufficient level from the input voltage through the set switch, the set switch is made non-conductive to isolate the input terminals from the capacitor until the capacitor has been discharged. Whereby the input voltage level detector can only respond to the external input voltage and not respond to the voltage accumulated in the capacitor so that it can immediately actuate the reset switch without a delay upon the input voltage decreasing below the trigger level for resetting the relay. In other words, the circuit can be free from a reverse current flow from the capacitor to the input terminal which might cause the unintended actuation of making the set switch conductive even after the input voltage level is lowered. Thus, the relay drive circuit of the present invention can successfully eliminate the response delay at the time of discharging the current to reset the relay and requires, for preventing the reverse current flow, no other devices such as the Darlington coupled transistors which requires a corresponding increase in the input voltage level or input power for driving the relay.

It is therefore a primary object of the present invention to provide a relay driving circuit which is capable of resetting the relay in quick and reliable response to the decrease in the input voltage level, yet requiring a minimum input voltage for energizing the excitation coil through the actuation of the set and reset switches.

In a preferred embodiment, the circuit is configured into a single IC chip with the input terminals, a first terminal set for connection with the series combination of the excitation coil and the capacitor, and a second terminal set for connection across the capacitor. The chip includes in the circuit a reference voltage generator which provides a reference voltage. The reference voltage is used at the input level detector for determination as to whether the input voltage exceeds the trigger voltage or not and also used at the disable switch for making the set switch conductive or non-conductive.

It is therefore another object of the present invention to provide a relay driving circuit configured into a single IC chip.

Additionally provided in the chip circuit is a reference voltage adjust means which, in response to an external signal, varies the reference voltage level so that the circuit of the present invention can be operated with differing trigger voltage levels.

It is therefore a further object of the present invention to provide a relay driving circuit which is capable of varying the trigger voltage level for setting and resetting the relay.

Further, the chip circuit has a gate terminal to receive an external reset signal which causes the input voltage level detector to provide the second control signal for resetting the relay irrespective of the input voltage being applied to the circuit.

It is therefore a still further object of the present invention to provide a relay driving circuit which is capable of resetting the relay in an overriding relation to the input voltage applied to the circuit.

The above and other objects and advantages of the present invention will become apparent from the following description of the embodiments of the present invention when taken in conjunction with the attached drawings.

DESCRIPTION OF THE PREFERRED EMBODIMENTS

Figure 1:
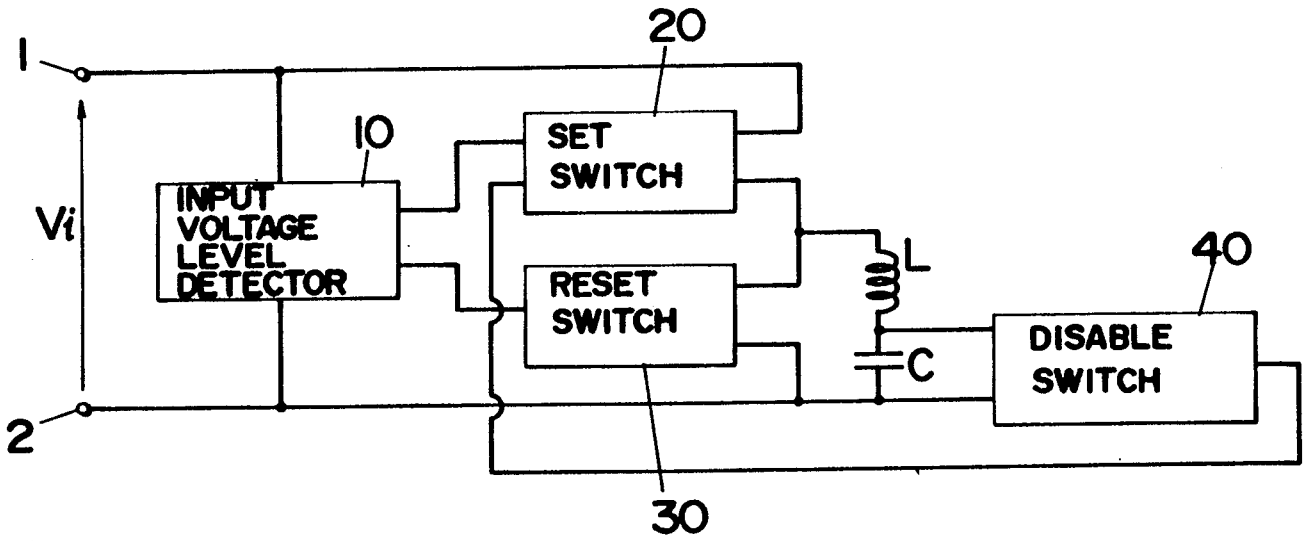
FIG. 1 is a block diagram of a relay driving circuit illustrating a preferred embodiment of the present invention.

Referring now to FIG. 1, there is shown a relay driving circuit in accordance with a preferred embodiment of the present invention. The circuit is intended to drive a latch-in type magnetic relay (not shown) having an excitation coil L and a relay contact. The relay assumes a set position of closing the relay contact when the excitation coil L is energized by a current of one polarity (hereinafter referred to as a set current) and assumes a reset position of opening the contact when the excitation coil L is energized by a current of opposite polarity (herein after referred to as a reset current).

A capacitor C is connected in series with the excitation coil L of the relay and responsible for providing the reset current as a discharge current therefrom. The circuit includes a pair of input terminals 1 and 2 for receiving an input control voltage which varies between two voltage levels. An input voltage level detector 10 is included in the circuit to detect the control or input voltage Vi applied across the input terminals 1 and 2 and determines whether the input voltage Vi exceeds a trigger voltage or not. When the input voltage is detected to exceed the trigger voltage, the detector 10 provides a first control output to a set switch 20. Otherwise, the detector 10 provides a second control output to a reset switch 30.

The set switch 10 is Connected in series with the series combination of the excitation coil L and the capacitor C and is made conductive in response to the first control signal from the input voltage level detector 10 so as to apply the input voltage Vi to the series combination of the excitation coil L and the capacitor C, thereby flowing the set current through the excitation coil L and charging the capacitor C. At this occurrence, the relay is actuated into the set position of closing the contact and is held in this position. The set switch 20 is kept conductive until the second control signal is issued from the detector 10 or the input voltage Vi is decreased below the trigger voltage level.

The reset switch 30 is connected across the series combination of the excitation coil L and the capacitor C and is made conductive in response to the second control signal so as to allow the capacitor C to discharge through the excitation coil L the current of the opposite polarity as the reset current. Thus, at this occurrence, the relay is actuated into the reset position and is held at this position until the detector 10 provides the first control signal. The above configuration is similar to the circuit of FIGS. 7 and 8.

The circuit of the present invention includes a disable switch 40 which monitors the voltage developed across the capacitor C and disables the set switch 20 or forcibly makes it non-conductive when the monitored voltage exceeds a level sufficient to provide the discharge or reset current through the excitation coil L for resetting the relay in the subsequent operation.

Figure 2:
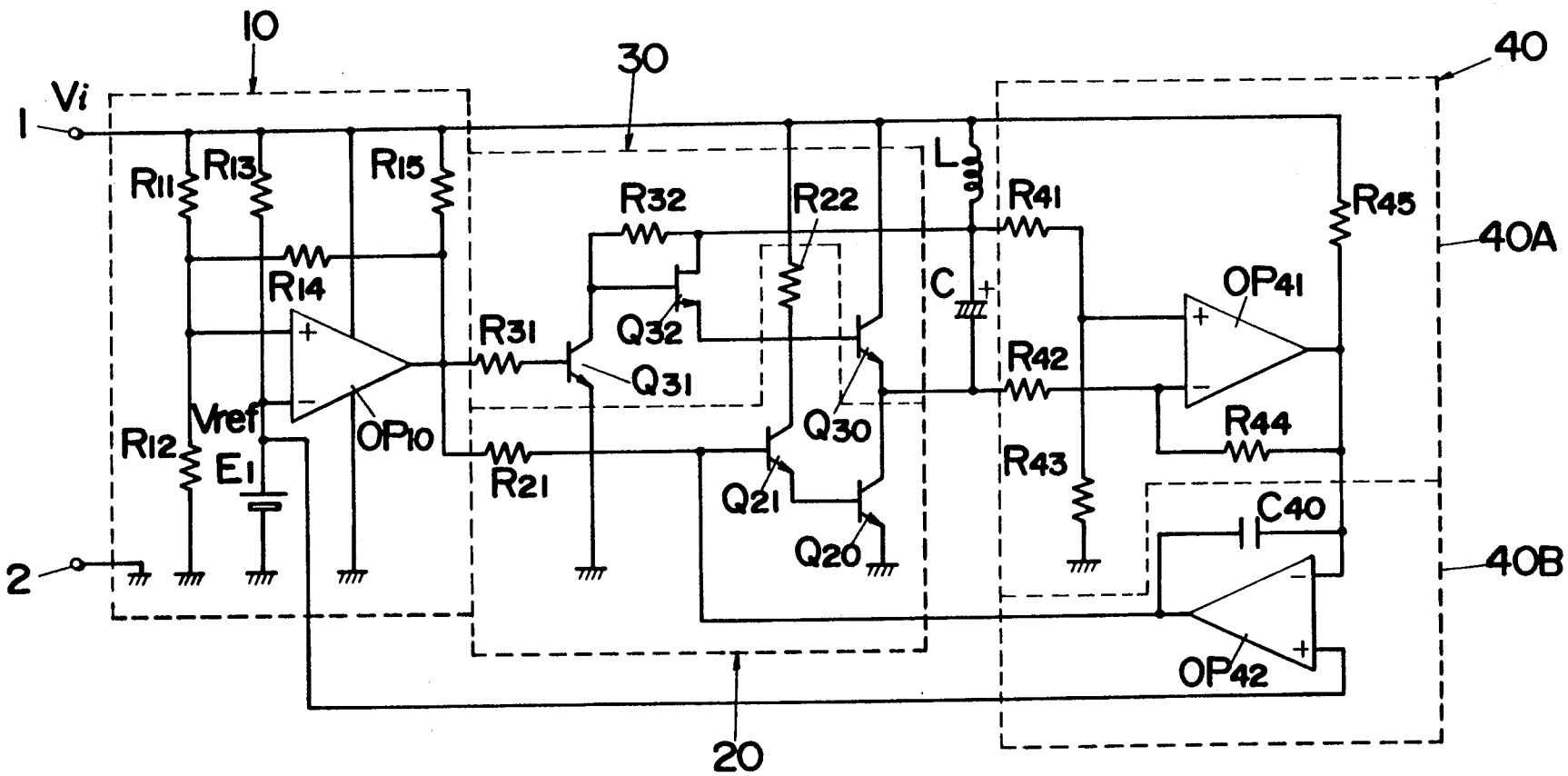
FIG. 2 is a detailed circuit configuration of the circuit of FIG. 1.

FIG. 2 illustrates a detailed configuration of the circuit in which the input voltage detector 10 comprises an operational amplifier $OP_{10}$, a resistor network of resistors $R_{11}$ through $R_{15}$, and a reference voltage source $E_1$ providing a reference voltage level Vref. The operational amplifier $OP_{10}$ compares the input voltage divided by the resistors $R_{11}$ and $R_{12}$ with the reference voltage level Vref and produces the first control (H-level) output when the divided input voltage exceeds the reference voltage Vref or the input voltage Vi exceeds the trigger voltage level. Otherwise the amplifier $OP_{10}$ provides the second control (L-level) output indicative of that the input voltage Vi is less than the trigger voltage. In this instance, the amplifier $OP_{10}$ produces the second control (L-level) output upon no substantial voltage being applied across the input terminals 1 and 2.

The set switch 20 comprises a pair of transistors $Q_{20}$, $Q_{21}$ and resistors $R_{21}$, $R_{22}$, in which transistor $Q_{20}$ is connected in series with the series combination of the excitation coil L and the capacitor C between the input terminals 1 and 2. Upon receiving the first control (H-level) output from the detector 10, transistor $Q_{21}$ is made conductive which in turn makes transistor $Q_{20}$ conductive to flow the set current from the input voltage through the excitation coil L and charge the capacitor C, actuating the relay into the set position. The reset switch 30 comprises transistors $Q_{30}$, $Q_{31}$, FET !$_{32}$, and resistors $R_{31}$ and $R_{32}$. Transistor $Q_{30}$ is connected across the series combination of the excitation coil L and the capacitor C, while transistor $Q_{31}$ and FET $Q_{32}$ are connected in a circuit to derive their operating voltage from the voltage developed across the capacitor C. When the second control (L-level) output is issued from the detector 10 as a result of that, for instance, the input voltage Vi is decreased to zero, transistors $Q_{21}$ and $Q_{20}$ of the set switch 20 are turned off while transistor $Q_{31}$ becomes non-conductive thereby turning on FET $Q_{32}$ and transistor $Q_{30}$. Thus, the series combination of the excitation coil L and the capacitor C is shunted by transistor $Q_{30}$, allowing the capacitor C to discharge the reset current which circulates the closed loop through the excitation coil L for resetting the relay. It is noted at this time that when the first control (H-level) output is issued from the detector 10, transistor $Q_{31}$ of the reset switch 30 is kept conductive to disallow the transistor $Q_{30}$ to turn on, thus maintaining the reset 30 switch non-conductive.

The disable switch 40 has two sections, one is a differential amplifier 40A comprising an operational amplifier $Q_{41}$ and resistors $R_{41}$ to $R_{45}$, and the other is a comparator 40B comprising an operational amplifier $OP_{42}$ and a capacitor $C_{40}$. The differential amplifier 40A provides an output voltage proportional to the voltage developed across the capacitor C. The output voltage of the amplifier 40A is then compared at the comparator 40B with a second reference voltage, which may be the same reference level Vref at the detector 10, to provide a L-level output when the former exceeds the latter and provides an H-level output in the opposite condition, such output of the comparator 40B is fed to a base of transistor $Q_{22}$ of the set switch 20. The output voltage of the amplifier 40A and the second reference voltage Vref are selected such that the comparator 40B provides the L-level output when the capacitor C is charged up to a certain level sufficient to be ready for providing the reset current through the excitation coil L for resetting the relay.

Figure 3A:
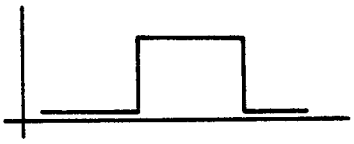
FIGS. 3A and 3B illustrates waveforms of input voltage that may be applied to the above circuit.
Figure 3B:
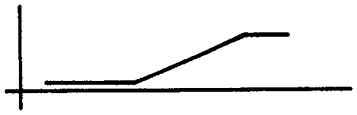

Thus, each time the capacitor C is charged sufficiently from the input voltage Vin, the comparator 40B provides the low level output, which is a disable signal causing transistor $Q_{21}$ and in turn transistor $Q_{20}$ of the set switch 20 to be non-conductive. Once this occurs, the capacitor C is disconnected from the input terminals 1 and 2 so that the voltage accumulated in the capacitor C will be not applied to the detector 10, or no reverse current will flow from the capacitor C to the input terminals 1 and 2. Thus, at the time of resetting the relay by decreasing the input voltage Vi to zero or below the trigger level, the detector 10 is kept prevented from receiving the voltage of the capacitor C and therefore prevented from providing the first control (H-level) output making the set switch 20 conductive. Whereby the detector 10 provides, in prompt response to the decreased input voltage Vin, the second control (L-level) output to make the reset switch 30 conductive for immediate resetting of the relay. In this manner, the voltage accumulated in the capacitor C will not act in a reverse and unintended manner to provide a false high level output at the input voltage level detector 10 which would be the cause of response delay in resetting the relay. It should be noted at this time that the detector 10 responds not only to the input voltage in the form of a rectangular pulse of FIG. 3A but also to an input voltage in the form of a gradually increasing level as shown in FIG. 3B for providing the first control (H-level) output.

Figure 4:
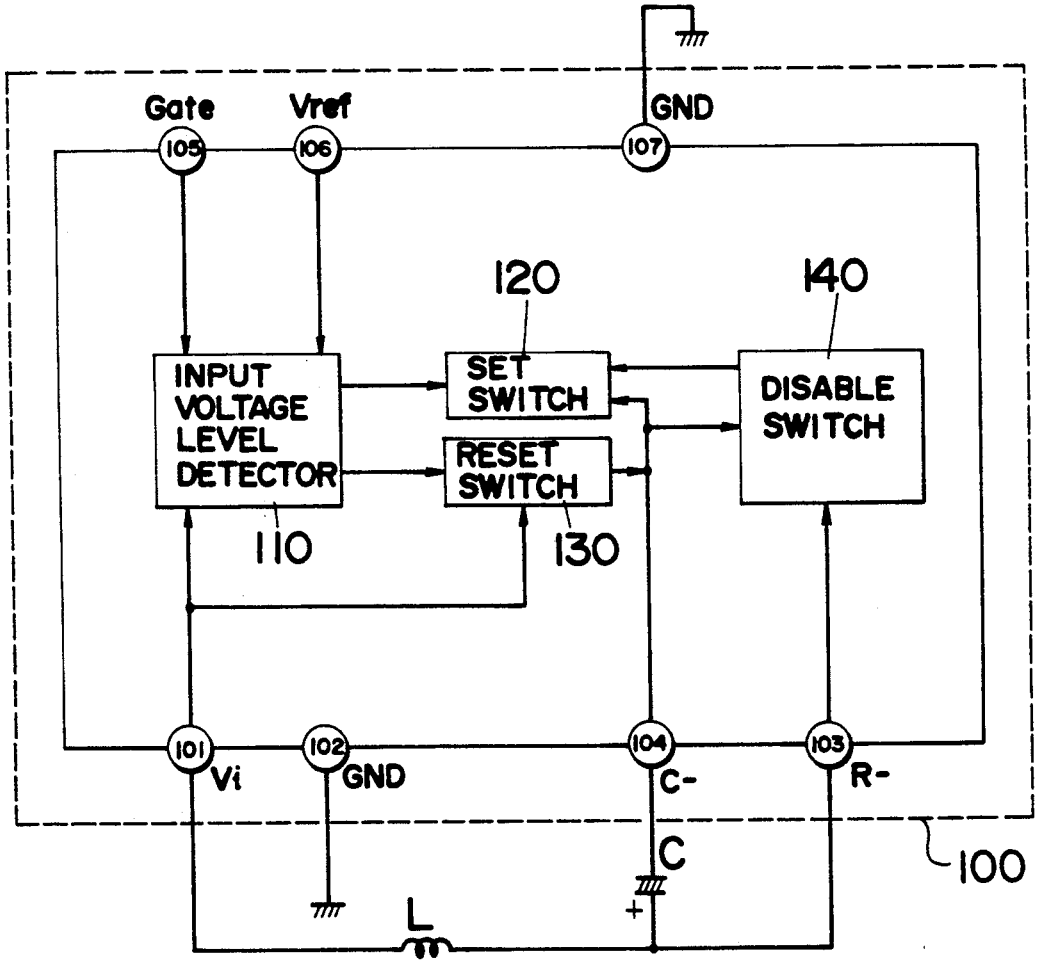
FIG. 4 is a block diagram of a modification of the above circuit.
Figure 5:
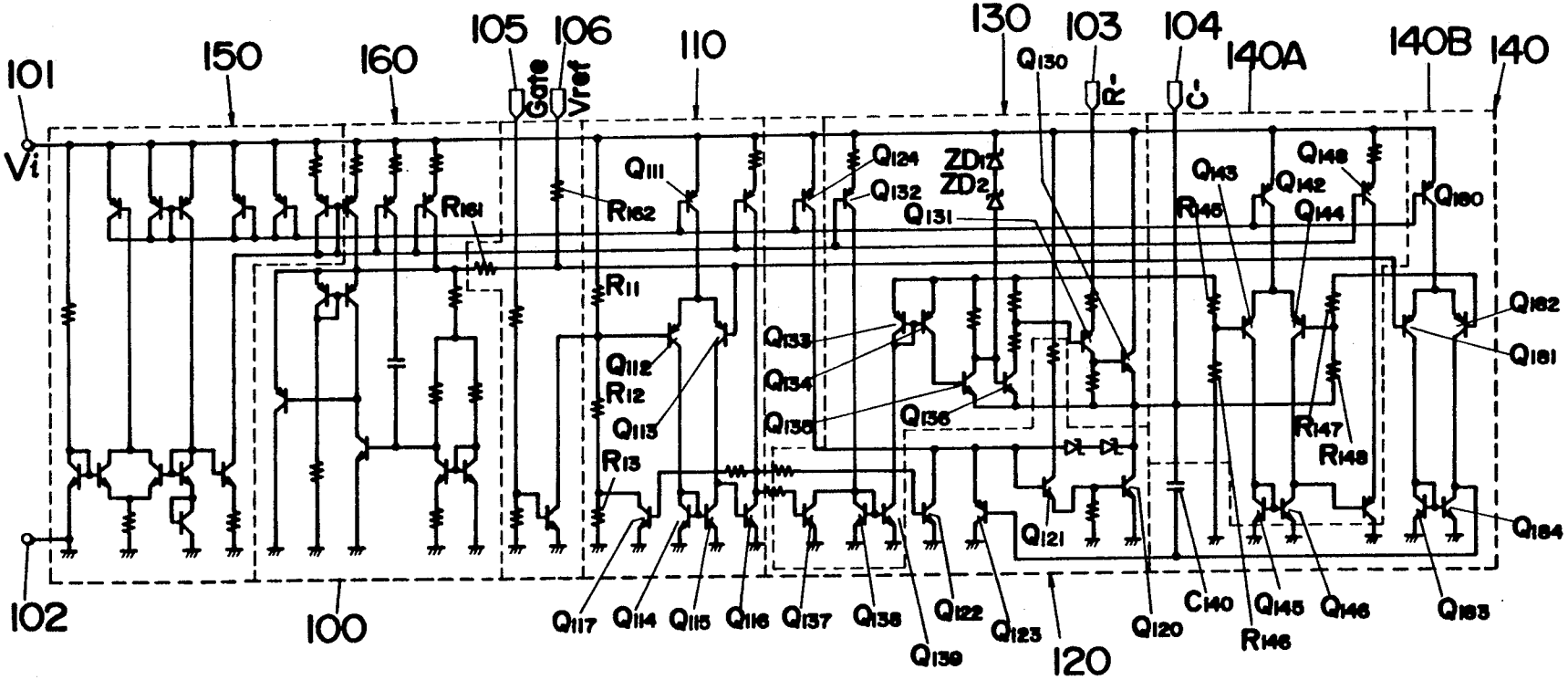
FIG. 5 is a detailed circuit configuration of the circuit of FIG. 4.

Referring to FIGS. 4 and 5, there is illustrated a modification of the above circuit. The modification is intended to establish the circuit in a single IC chip and is identical to the circuit of the above embodiment except that the modification additionally incorporates a fixed current generator 150 and a reference voltage generator 160. As illustrated in FIG. 4, the modified circuit comprises an input voltage level detector 110, a set switch 120, a reset switch 130, and a disable switch 140 which are provided in the same functional arrangements as in the above embodiment. These components are realized in the single IC chip (indicated by a rectangular 100 in FIGS. 4 and 5) which has set of an input voltage terminal 101 and a ground terminal 102, a first terminal 103, a second terminal 104. The first and second terminals 103 and 104 are utilized for connection with an external circuit of an excitation coil L of the relay and a capacitor C. Also provided at the IC chip are a gate terminal 105, reference voltage adjust terminal 106, an additional ground terminal 107.

The reference current generator 150 enables fixed current operations for several portions of the circuit, while the reference voltage generator 160 provides a reference voltage Vref for use in the detector 110 and in the disable switch 140. As shown in FIG. 5, the reference voltage generator 160 has its output connected to the reference voltage adjust terminal 106 through dividing resistors $R_{161}$ and $R_{162}$ such that it is possible to provide the reference voltage of differing levels. That is, when the reference voltage adjust terminal 106 is wired to the ground terminal 107 the output of the generator 160 is divided by resistors $R_{161}$ and $R_{162}$ to provide a lower reference voltage than a default voltage which is the output of the generator 160 when no such wiring is made. Thus, the reference voltage can be selected between the default high voltage, i.e., 5 V and the lowered voltage, i.e., 3 V as demanded by a specific device in which the circuit is utilized.

The input voltage level detector 110 is a comparator comprising transistors $Q_{111}$ to $Q_{116}$ and resistors $R_{111}$ to $R_{113}$. When the input voltage Vi divided by resistors $R_{111}$ and $R_{112}$ goes above the reference voltage Vref, transistor $Q_{116}$ is while making the reset switch 130 non-conductive. It is noted at this point that the comparator 110 has hysteresis function of increasing the input level by providing transistor $Q_{117}$ which is connected across resistor $R_{113}$ in series with the dividing resistor $R_{112}$ and is arranged to turn off when transistor $Q_{116}$ is turned on, thus ensuring a stable operation.

The set switch 120 comprises transistor $Q_{120}$ to $Q_{123}$, while the reset switch 130 comprises transistors $Q_{130}$ to $Q_{136}$. When transistor $Q_{116}$ of the detector 110 is turned on as a result of which the input voltage Vi is detected to exceed the reference voltage Vref, transistor $Q_{122}$ of the set switch 120 is turned off to provide a base current to transistor $Q_{121}$ from transistor $Q_{124}$ acting as a fixed current source, thereby making transistors $Q_{121}$ and $Q_{120}$ of the set switch 120 Conductive for providing the set current through the excitation coil L. At this condition, transistor $Q_{137}$ is turned off so as to apply a fixed current to a current mirror of transistor $Q_{133}$ and $Q_{134}$ from transistor $Q_{132}$ acting as a fixed current source through another current mirror of transistors $Q_{136}$ and $Q_{139}$, thereby turning transistors $Q_{135}$ and $Q_{136}$ on and off, respectively and therefore turning off transistors $Q_{131}$ and $Q_{130}$ to make the reset switch 130 non-conductive.

Upon turning off of transistor $Q_{116}$ of the detector 110 as a result of that the input voltage Vi is detected to be decreased below the reference voltage Vref, transistor $Q_{130}$ is turned on to make the reset switch 130 conductive for providing the reset current through the excitation coil L while transistor $Q_{120}$ is turned off to make the set switch 120 non-conductive.

Likewise in the embodiment of FIG. 2, the disable switch 140 has a differential amplifier 140A and a comparator 140B. In the circuit of FIG. 5, the differential amplifier 140A is realized by transistors $Q_{142}$ to $Q_{146}$ and resistors $R_{145}$ to $R_{148}$, and the comparator 240B is realized by transistors $Q_{180}$ to $Q_{184}$ and a capacitor $C_{140}$. When the capacitor C is charged by the input voltage applied to the circuit up to a level exceeding the reference voltage Vref of the comparator 140B, the comparator provides a L-level output to and turn on transistor $Q_{123}$ inserted between a fixed current supplying line $L_2$ to the set switch 120 and the ground, thereby turning off transistors $Q_{121}$ and $Q_{120}$ to disable the reset switch 120, or disallowing the voltage of the capacitor C to be reversely applied to the detector 110.

When the input voltage Vi is decreased to zero or below the reference voltage level Vref of the detector 110, transistor $Q_{116}$ is turned off to cease providing a fixed current to the current mirror of transistors $Q_{138}$ and $Q_{139}$, thereby turning on transistor $Q_{130}$ and therefore allowing the capacitor C to discharge the reset current through the excitation coil L for resetting the relay. At this occurrence, transistor $Q_{121}$ receives no base current, thereby maintaining transistor $Q_{121}$ off and therefore keeping the set switch 120 non-conductive.

The gate terminal 105 is included to give to the circuit an external signal which generates the reset current through the excitation coil L irrespective of the input voltage level at the input terminal 101 for forcibly resetting the relay. That is, when a voltage signal is applied to the gate terminal 105, the input voltage to the detector 110 is pulled down below the reference voltage Vref. Whereby the detector 110 responds to provide the second control (L-level) signal in the same way as the input voltage to the circuit is decreased below the reference level, making the reset switch 130 conductive to reset the relay.

Figure 6:
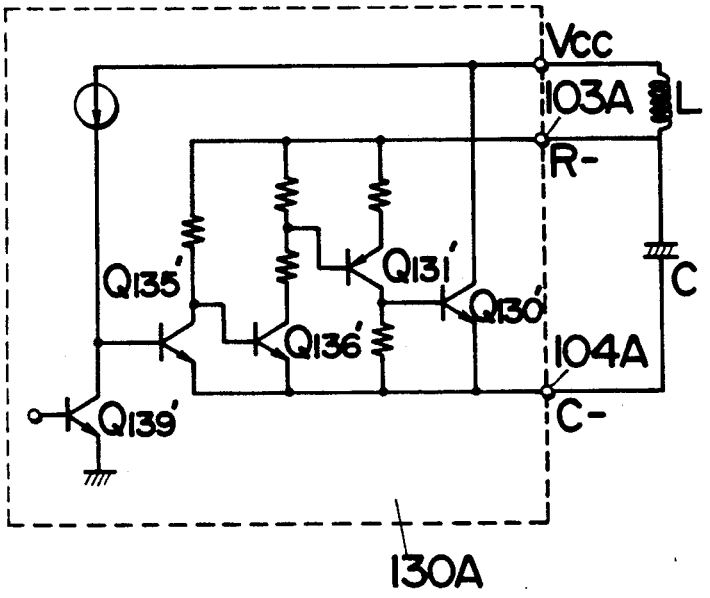
FIGS. 6 and 7 are respectively circuit diagrams which may be alternatively utilized as a reset switch in the circuit of FIG. 5.
Figure 7:
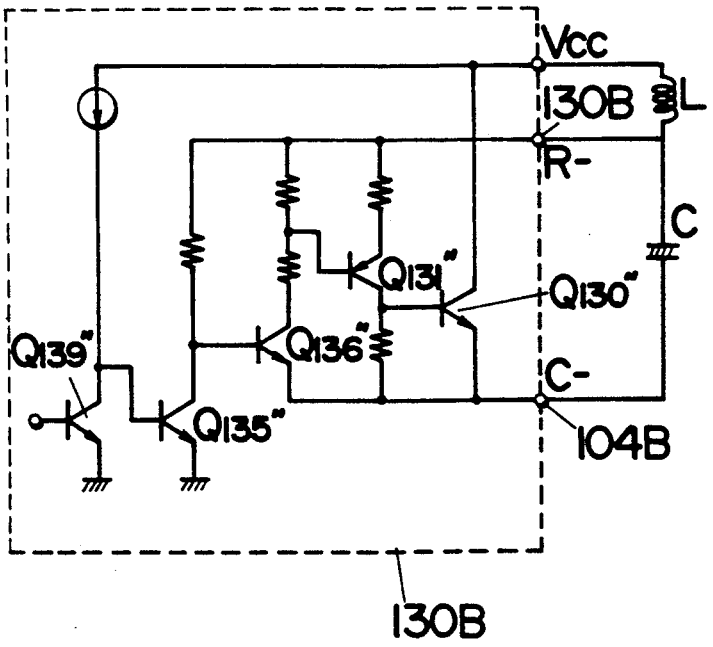
Figure 8:
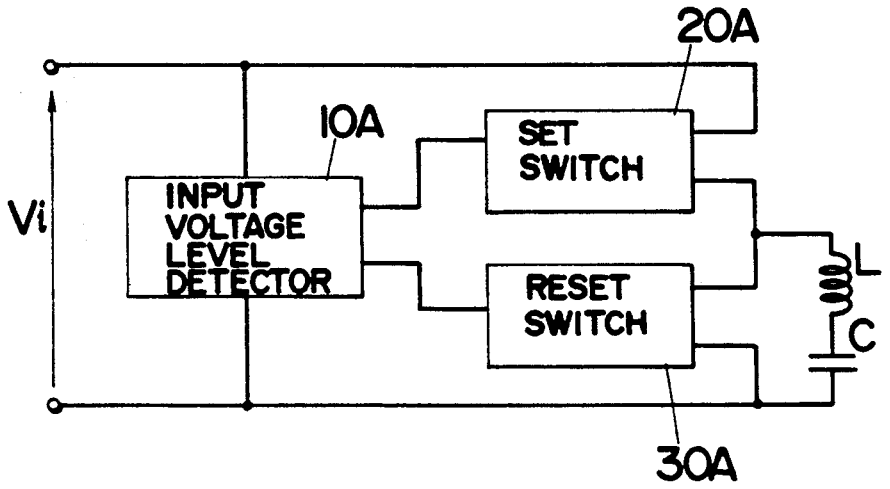
Fig.8 PRIOR ART
FIG. 8 is a block diagram of a prior relay driving circuit.
Figure 9:
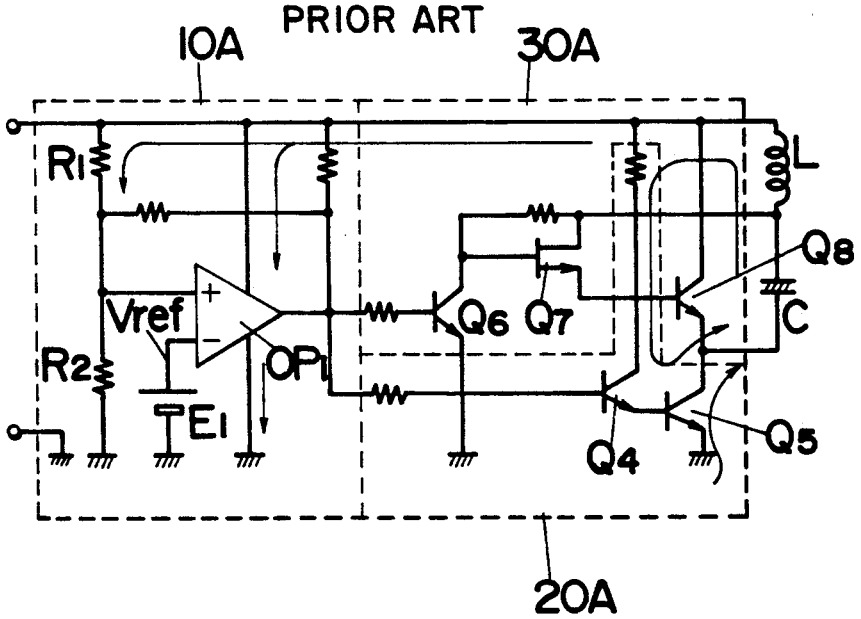
Fig.9 PRIOR ART
FIG. 9 is a circuit configuration of the prior circuit of FIG. 8.
Figure 10:
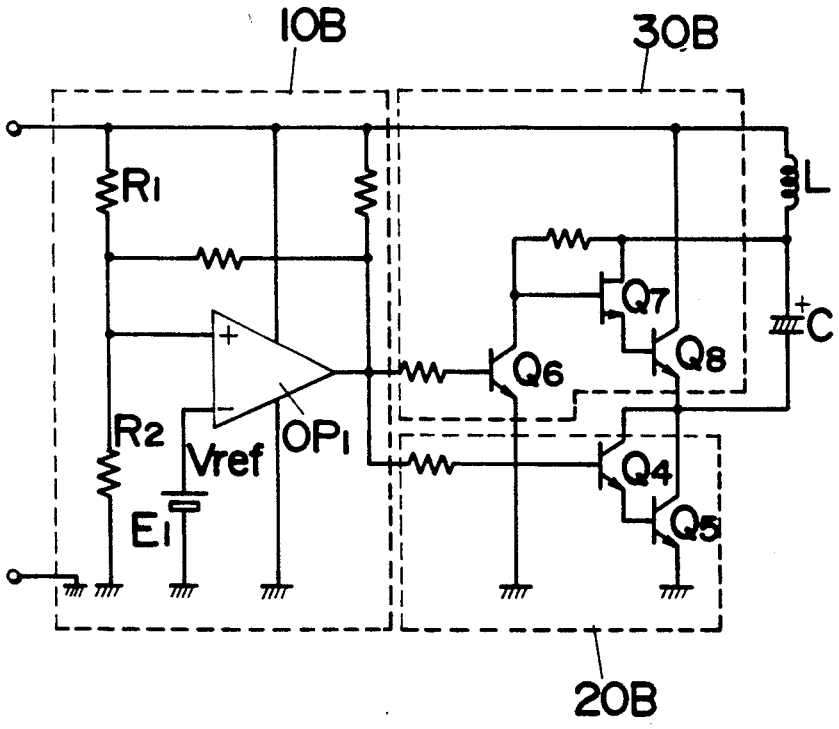
Fig.10 PRIOR ART
FIG. 10 is a circuit configuration of another prior relay driving circuit.

Although the reset switch 130 may be alternatively configured into a circuit of FIG. 6 or FIG. 7, the circuit of FIG. 6 is found advantageous over the circuits of FIGS. 6 and 7 in assuring a stable reset operation.

Specifically, the reset circuit of FIG. 5 can eliminate undesirable error-inducing effects influenced by a counter electromotive force which may be developed at the excitation coil L and may cause the first terminal 103 to have a voltage higher than the input voltage Vi or cause the second terminal 104 to have a voltage less than the ground level. For instance, when the circuit 130A of FIG. 6 sees at the first terminal 103A a voltage higher than the input voltage Vi due to the counter electromotive force developed at the excitation coil L, the second terminal 104A receives a correspondingly higher voltage through the capacitor C so as to reversely bias transistor $Q_{135}$ and turn on transistor $Q_{130}$, resulting in an unintended or erroneous conduction of the reset switch 130A.

Also, when the circuit 130B of FIG. 7 sees at the second terminal 104B a voltage less than the ground level due to the counter electromotive force, transistor $Q_{136''}$ will be then reversely biased to turn on transistor $Q_{130''}$, also resulting in the erroneous conduction of the reset switch 130B.

To eliminate such undesirable effect, the reset switch 130 of FIG. 5 is configured to provide a series pair of Zenor diodes $ZD_1$ and $ZD_2$ between the base of transistor $Q_{136}$ of the reset switch 130 and the input voltage line and at the same time to connect the emitter of transistor $Q_{135}$ to the emitter of transistor $Q_{136}$.

What is claimed is:

1. A relay driving circuit for a latch-in type magnetic relay having an excitation coil which causes said relay to assume a set position which closes a relay contact when energized by a set current of given polarity and to assume a reset position which opens the relay contact when energized by a reset current of opposite polarity, said circuit comprising:

a pair of input terminals to which an input voltage is applied;

a capacitor in series with said excitation coil of the latch-in relay;

an input voltage level detector connected across said input terminals to provide a first control signal when said input voltage is detected to have a level exceeding a predetermined trigger voltage level and to provide a second control signal when said input voltage is detected to have a level not exceeding said predetermined trigger voltage level;

a set switch connected in a series relation with said series combination of the excitation coil and the capacitor, said set switch connected between said input terminals, said set switch being conductive in response to said first control signal, to apply said input voltage to the series combination of said excitation coil and the capacitor for providing said set current through said excitation coil and charging said capacitor;

a reset switch connected across said series combination of the excitation coil and the capacitor, said reset switch being conductive, in response to said second control signal, to allow said capacitor to discharge a current as said reset current in the opposite direction of said set current through said excitation coil;

disable switch means which monitors a voltage developed across said capacitor and rendering said set switch non-conductive when said capacitor is charged up to a voltage level sufficient to provide said reset current to the excitation coil, whereby the disable switch means prevents the voltage of said capacitor from being applied to the input terminals or said input voltage level detector.

2. A relay driving circuit as set forth in claim 1, wherein said disable switch means comprises a differential amplifier providing an output having a level which is proportional to the level of the voltage developed across said capacitor and a comparator which compares the output of said differential amplifier with a reference voltage level and provides a disable signal when the output of said differential amplifier exceeds the reference voltage level, and said disable signal being indicative of the voltage of the capacitor becoming charged up to a sufficient level for providing said reset current to said excitation coil, said disable signal causing said set switch to be non-conductive.

3. A relay driving circuit as set forth in claim 1, wherein said input voltage level detector, set switch, reset switch, and disable switch means are constructed within a single integrated circuit chip, said chip having said input terminals, a first terminal set for connection with said series connection with the capacitor and the excitation coil of the relay, and a second terminal set for connection across said capacitor.

4. A relay driving circuit as set forth in claim 3, wherein said integrated circuit chip additionally includes a reference voltage generator which provides a reference voltage which is used at the input voltage detector for determination of the input voltage level exceeding or not exceeding the predetermined trigger voltage level and at the disable switch means for actuating said set switch to be conductive or non-conductive.

5. A relay driving circuit as set forth in claim 3, wherein said integrated circuit chip has a gate terminal to receive an external reset signal which causes the input voltage level detector to provide said second control signal irrespective of the level of said input voltage applied to the circuit so as to make the set switch non-conductive and make the reset switch conductive for resetting the relay even when the input voltage is of such a level to set the relay.

6. A relay driving circuit as set forth in claim 3, wherein said integrated circuit chip includes means for varying the predetermined trigger voltage level upon receiving an external signal, said external signal being generated by wiring connection between a pair of terminal leads provided on the chip.

7. A relay driving circuit as set forth in claim 1, wherein said circuit include means for varying the predetermined trigger voltage level upon receiving an external signal.

* * * * *